US010642213B2

(12) United States Patent
Nameki

(10) Patent No.: US 10,642,213 B2
(45) Date of Patent: May 5, 2020

(54) IMAGE FORMING APPARATUS WITH CLEANING BLADE AND IMAGE BEARING MEMBER HAVING RECESSES

(71) Applicant: CANON KABUSHIKI KAISHA, Tokyo (JP)

(72) Inventor: Ryo Nameki, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/229,005

(22) Filed: Dec. 21, 2018

(65) Prior Publication Data

US 2019/0196390 A1 Jun. 27, 2019

(30) Foreign Application Priority Data

Dec. 27, 2017 (JP) ..... 2017-252606

(51) Int. Cl.
*G03G 21/00* (2006.01)

(52) U.S. Cl.
CPC ..... *G03G 21/0017* (2013.01)

(58) Field of Classification Search
CPC .. G03G 15/168; G03G 15/1685; G03G 15/75; G03G 15/751; G03G 21/0011; G03G 21/0017
USPC ..... 399/101, 159, 350
See application file for complete search history.

(56) References Cited

U.S. PATENT DOCUMENTS 6,453,137 B2 * 9/2002 Iinuma ..... G03G 15/751 399/159
7,266,329 B2 * 9/2007 Matsuo et al. ..... G03G 15/75 399/159
8,909,100 B2 * 12/2014 Takahashi et al. .. G03G 15/751 399/159
9,817,358 B2 11/2017 Abe et al.
9,971,258 B2 5/2018 Kitamura et al.

FOREIGN PATENT DOCUMENTS

JP 2007-033856 A 2/2007
JP 2008-257011 A 10/2008
JP 2009-014979 A 1/2009
JP 2016-071380 A 5/2016
JP 2016-208601 A 12/2016
JP 6094780 B2 3/2017

* cited by examiner

*Primary Examiner* — William J Royer
(74) *Attorney, Agent, or Firm* — Venable LLP

(57) ABSTRACT

A cleaning blade, which is to be brought into contact with a surface of a photosensitive drum, satisfies the following condition. First, the cleaning blade having a free length of 8 mm is brought into contact with an opposed object for measurement having a plurality of measurement recesses each having a partially spherical shape with a depth of 0.7 μm and a radius of 15 μm on a surface so that a linear pressure is 0.196 N/cm and 0.490 N/cm, and a contact angle with respect to the opposed object for measurement is 25°. In this case, a contact width of the cleaning blade in each of the measurement recesses is 4 μm or more and 8 μm or less when the linear pressure is 0.196 N/cm and is 4 μm or more and 13.5 μm or less when the linear pressure is 0.490 N/cm.

7 Claims, 11 Drawing Sheets

IMAGE FORMING APPARATUS WITH CLEANING BLADE AND IMAGE BEARING MEMBER HAVING RECESSES

BACKGROUND OF THE INVENTION

Field of the Invention

The present invention relates to an image forming apparatus, such as a copying machine, a printer, a facsimile machine, and a multifunction peripheral having a plurality of functions of those apparatus.

Description of the Related Art

As a configuration of an image forming apparatus, there has hitherto been known the following configuration. A toner image is formed on a surface of a photosensitive drum, and then is transferred onto an intermediate transfer belt and a recording material. After the transfer of the toner image, toner remaining on the photosensitive drum is removed with a cleaning blade.

As the cleaning blade, there have been proposed cleaning blades having configurations disclosed in Japanese Patent No. 6094780 and Japanese Patent Application Laid-Open No. 2016-208601. Further, as the photosensitive drum, for example, according to description in Japanese Patent Application Laid-Open No. 2016-71380, there has been proposed a photosensitive drum having a plurality of independent recesses formed on a surface.

It has been found that, in the case of the configuration of the photosensitive drum, which serves as an image bearing member, having the plurality of recesses on the surface as described in Japanese Patent Application Laid-Open No. 2016-71380, formation of a toner image having a high image ratio under a high-temperature and high-humidity environment causes occurrence of toner fusion, which is fusion of toner originating from each of the recesses.

SUMMARY OF THE INVENTION

An object of the present invention is to provide a configuration capable of suppressing the occurrence of toner fusion with an image bearing member having a plurality of recesses in a surface thereof.

An aspect of the present invention is to provide an image forming apparatus comprising:

an image bearing member, which is configured to rotate while bearing a toner image; and a cleaning blade, which is to be brought into contact with a surface of the image bearing member, and is configured to clean the image bearing member, wherein the image bearing member has a plurality of recesses on a surface thereof, the plurality of recesses each having an aperture width of 5 μm or more and 100 μm or less in a rotational direction of the image bearing member, an aperture width of 5 μm or more and 100 μm or less in a width direction crossing the rotational direction of the image bearing member, and a depth of 0.1 μm or more and 3 μm or less, wherein the cleaning blade comprises a rubber member, a distal end portion of the cleaning blade, which is to be brought into contact with the image bearing member, having a hardness higher than a hardness of a base end portion, a contact force per unit length in a longitudinal direction of the cleaning blade with respect to the surface of the image bearing member being 0.196 N/cm or more and 0.490 N/cm or less, and wherein, when the cleaning blade is supported so that a free length from a position at which the cleaning blade is supported to a distal end of the cleaning blade is 8 mm, and when the cleaning blade is brought into contact with an opposed object for measurement having a plurality of measurement recesses each having a partially spherical shape with a depth of 0.7 μm and a radius of 15 μm on a surface so that a contact angle with respect to the opposed object for measurement is 25°, a contact width in a direction perpendicular to the longitudinal direction of the cleaning blade between the cleaning blade and the opposed object for measurement in each of the measurement recesses is 4 μm or more and 8 μm or less when the contact force per unit length in the longitudinal direction of the cleaning blade is 0.196 N/cm, and is 4 μm or more and 13.5 μm or less when the contact force per unit length in the longitudinal direction of the cleaning blade is 0.490 N/cm.

Further features of the present invention will become apparent from the following description of exemplary embodiments with reference to the attached drawings.

DESCRIPTION OF THE EMBODIMENTS

Figure 1:
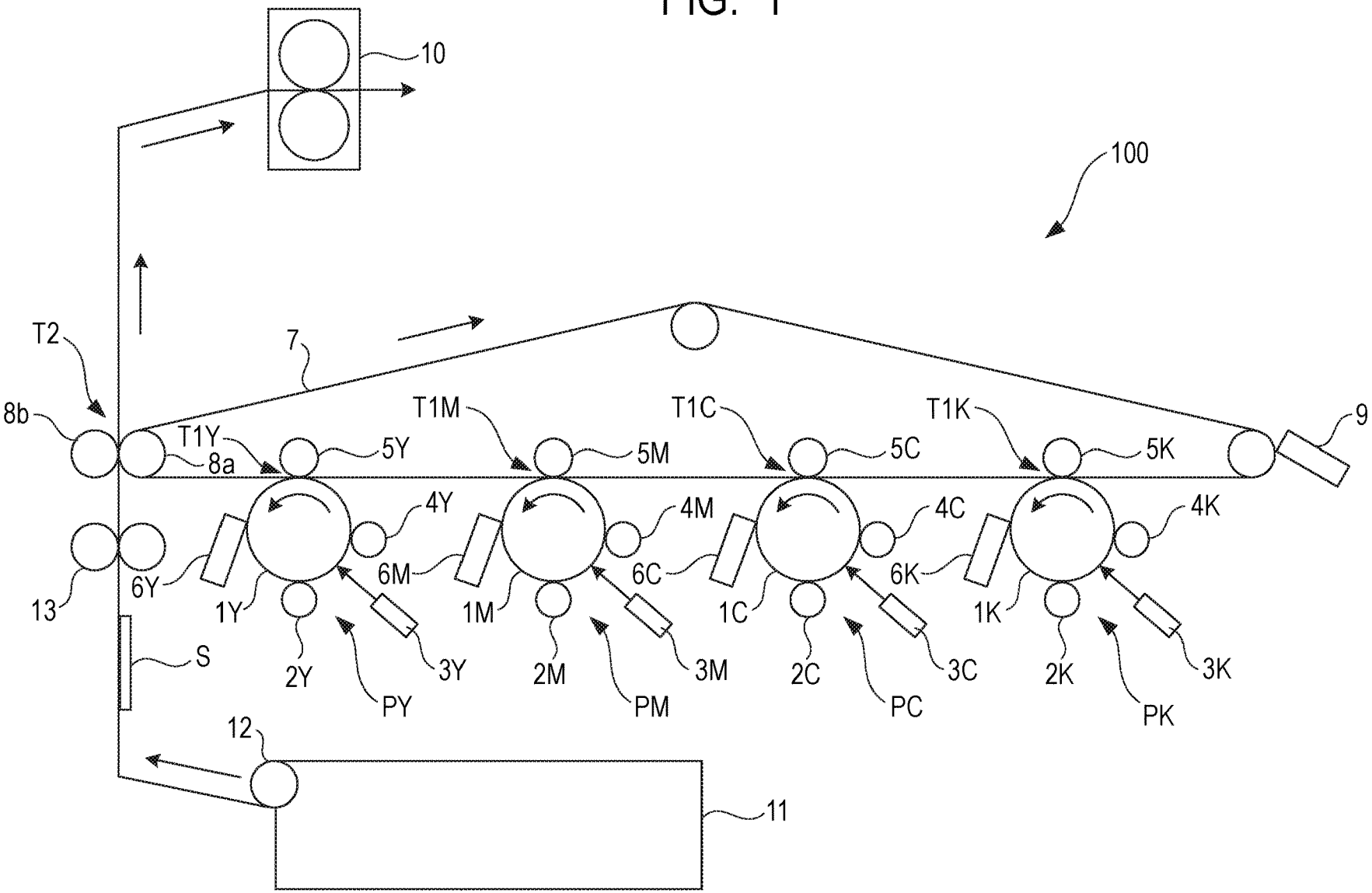
FIG. 1 is a view for illustrating a schematic configuration of an image forming apparatus according to one embodiment of the present invention.

One embodiment of the present invention is described with reference to FIG. 1 to FIG. 11. First, description is given of an image forming apparatus according to this embodiment with reference to FIG. 1.

[Image Forming Apparatus]

An image forming apparatus 100 is an electrophotographic full-color printer including four image forming portions PY, PM, PC, and PK provided correspondingly to four colors of yellow, magenta, cyan, and black, respectively. In this embodiment, there is employed a tandem type in which the image forming portions PY, PM, PC, and PK are arranged along a rotation direction of an intermediate transfer belt 7 described later. The image forming apparatus 100 is configured to form a toner image (image) on a recording material S in accordance with an image signal from an original reading apparatus (not shown) connected to a main body of the image forming apparatus 100 or from a host apparatus such as a personal computer communicatably connected to the main body of the image forming apparatus 100. As the recording material S, there may be given sheet materials such as paper, a plastic film, and a cloth.

The outline of such image forming process is now described. First, in the image forming portions PY, PM, PC, and PK, toner images of respective colors are formed on the respective photosensitive drums (electrophotographic photosensitive members) 1Y, 1M, 1C, and 1K, each serving as an image bearing member. The toner images of the respective colors formed in this manner are transferred onto the intermediate transfer belt 7, and are subsequently transferred from the intermediate transfer belt 7 onto the recording material S. The recording material S having the toner images transferred thereon is conveyed to a fixing device 10, and the toner images are fixed onto the recording material S. The detailed description is given below.

The four image forming portions PY, PM, PC, and PK of the image forming apparatus 100 have substantially the same structure except that developer colors are different. Therefore, in the following, the image forming portion PY is described as a representative, and description of the configurations of the other image forming portions is omitted.

In the image forming portion PY, there is arranged a cylindrical photosensitive member serving as an image bearing member, that is, the photosensitive drum 1Y. The photosensitive drum 1Y is driven to rotate in a direction indicated by the arrow in FIG. 1. Around the photosensitive drum 1Y, there are arranged a charge roller (charging device) 2Y, a developing device 4Y, a primary transfer roller 5Y, and a drum cleaner 6Y. A laser scanner (exposure device) 3Y is arranged below the photosensitive drum 1Y in FIG. 1.

Further, the intermediate transfer belt 7 is arranged so as to be opposed to the photosensitive drums 1Y, 1M, 1C, and 1K. The intermediate transfer belt 7 is tensioned by a plurality of tension rollers, and is circumferentially moved (rotated) in a direction indicated by the arrow in FIG. 1 through drive of drive rollers among the plurality of tension rollers. A secondary transfer outer roller 8*b* is arranged at a position opposed to a secondary transfer inner roller 8*a* among the plurality of tension rollers across the intermediate transfer belt 7, and thus, a secondary transfer portion T2 configured to transfer the toner image on the intermediate transfer belt 7 onto the recording material S is formed. The fixing device 10 is arranged on a downstream side of the secondary transfer portion T2 in a recording material conveyance direction.

A process of forming an image by the image forming apparatus 100 having the above-mentioned configuration is described. First, when an image forming operation is started, the surface of the photosensitive drum 1Y being rotated is uniformly charged by the charge roller 2Y. Next, the photosensitive drum 1Y is exposed with laser light corresponding to an image signal emitted from the exposure device 3Y. With this, an electrostatic latent image corresponding to the image signal is formed on the photosensitive drum 1Y. The electrostatic latent image on the photosensitive drum 1Y is developed into a visible image with toner stored in the developing device 4Y.

The toner image formed on the photosensitive drum 1Y is primarily transferred onto the intermediate transfer belt 7 at a primary transfer portion T1Y that is formed between the photosensitive drum 1Y and the primary transfer roller 5Y with the intermediate transfer belt 7 interposed therebetween. The toner (untransferred residual toner) remaining on the surface of the photosensitive drum 1Y after the primary transfer is removed by the drum cleaner 6Y.

Such operation is sequentially performed in the respective image forming portions PM, PC, and PK of magenta, cyan, and black, and the toner images of four colors are superposed on one another on the intermediate transfer belt 7. After that, in synchronization with a timing of forming the toner images, the recording material S accommodated in a cassette 11 is picked out by a pickup roller 12 and conveyed to registration rollers 13. Then, skew feed of the recording material S is corrected by the registration rollers 13, and the recording material S is conveyed to the secondary transfer portion T2 by the registration rollers 13 in synchronization with the toner images on the intermediate transfer belt 7. Then, the toner images of four colors on the intermediate transfer belt 7 are secondarily transferred in a collective manner onto the recording material S. Toner that remains on the intermediate transfer belt 7 without being transferred at the secondary transfer portion T2 is removed by a belt cleaner 9.

Next, the recording material S is conveyed to the fixing device 10. Then, the recording material S is heated and pressurized by the fixing device 10 so that the toner on the recording material S is molten and mixed to be fixed as a full-color image onto the recording material S. After that, the recording material S is delivered to an outside of the image forming apparatus 100. With this, the series of the image forming processes are completed. A single-color image of a desired color or a multi-color image of desired colors may be formed by using only the image forming portion of the desired color.

Next, the configurations of the charge roller 2Y, the exposure device 3Y, the developing device 4Y, and the primary transfer roller 5Y in the image forming portion PY, and the intermediate transfer belt 7 are described in detail. The detailed configurations of the photosensitive drum 1Y, the drum cleaner 6Y, and the belt cleaner 9 are described later.

[Charge Roller]

The charge roller 2Y is a contact-type charging unit configured to uniformly charge the surface of the photosensitive drum 1Y. In this embodiment, the charge roller 2Y has a length of 330 mm in a rotational axis direction and a diameter of 14 mm, and has a configuration in which an electrically conductive rubber layer is formed on an outer periphery of a metal core made of stainless steel. The charge roller 2Y is rotatably held by bearings at both end portions of the metal core, respectively, and is urged toward the photosensitive drum 1Y by a pressure spring to be brought into pressure contact with the surface of the photosensitive drum 1Y with a predetermined pressure force. With this, the charge roller 2Y rotates (peripheral speed of 300 mm/sec) along with rotation of the photosensitive drum 1Y.

The charge roller 2Y is configured to charge the photosensitive drum 1Y through use of a discharge phenomenon that occurs in a minute gap between the charge roller 2Y and the photosensitive drum 1Y. The metal core of the charge roller 2Y is applied with a charging voltage under a predetermined condition by a power supply (not shown). In this embodiment, the power supply is formed of a DC power source and an AC power source. For example, when a DC voltage to be applied is set to −500 V, and an AC voltage is set to a value that is twice or more of a discharge start voltage in that environment, an image forming region of the rotating photosensitive drum 1Y is uniformly charged to about −500 V. The DC voltage to be applied during image formation is not limited to the above-mentioned value and is appropriately set to an electric potential suitable for preferred image formation in accordance with the environment, the usage condition of the photosensitive drum 1Y and the charge roller 2Y, and the like.

[Exposure Device]

The exposure device 3Y is an information writing unit configured to form an electrostatic latent image on the charged surface of the photosensitive drum 1Y. In this embodiment, the exposure device 3Y is a laser beam scanner using a semiconductor laser. The laser beam scanner is configured to output laser light modulated in accordance with an image signal sent from a host apparatus such as an original reading apparatus to the image forming apparatus 100 side, and subject the uniformly charged surface of the rotating photosensitive drum 1Y to laser scanning exposure. Due to the laser scanning exposure, the absolute value of the electric potential at a portion of the surface of the photosensitive drum 1Y, which is irradiated with the laser light, decreases, and electrostatic latent images corresponding to image information are sequentially formed on the surface of the rotating photosensitive drum 1Y.

[Developing Device]

The developing device 4Y is a developing unit configured to supply toner in accordance with the electrostatic latent image on the photosensitive drum 1Y and subject the electrostatic latent image to reverse development to form a toner image. The developing device 4Y includes a developer container and a developing sleeve. The developer container is configured to accommodate a two-component developer containing non-magnetic toner and a carrier of a magnetic material. The developing sleeve serves as a developer carrier configured to carry and convey the developer accommodated in the developer container. In FIG. 1, this developing sleeve is illustrated as the developing device 4Y. The developing sleeve is arranged so as to be opposed to the photosensitive drum 1Y, and is configured to rotate and convey the developer carried thereon to a developing region opposed to the photosensitive drum 1Y. The length of the developing sleeve in a rotational axis direction is 325 mm.

In this embodiment, the developing sleeve holds a magnetic brush of the two-component developer, and is configured to perform development while bringing the magnetic brush into contact with the photosensitive drum 1Y. Further, as the toner, toner having an average particle diameter of about 6 μm, which is obtained by kneading a pigment into a resin binder mainly containing polyester, followed by pulverization and classification, is used. Further, the toner adhering to the photosensitive drum 1Y has an average charge amount of −30 μC/g.

Further, from the viewpoint of low-temperature fixability that has been desired in recent years, toner having a low glass transition temperature Tg tends to be used. Therefore, in this embodiment, it is preferred that toner having a glass transition temperature Tg of 65° C. or less be used. It is more preferred that toner having a glass transition temperature Tg of 55° C. or less be used. In this embodiment, toner having a glass transition temperature Tg of 55° C. is used.

The developing device 4Y is applied with a predetermined developing voltage from a power supply (not shown). In this embodiment, the predetermined developing voltage is an oscillation voltage in which a DC voltage (Vdc) and an AC voltage (Vac) are superposed on one another. For example, the oscillation voltage is an oscillation voltage in which rectangular-wave AC voltages each having a frequency of 8.0 kHz and a peak-to-peak voltage of 1.8 kV are superposed on one another. The DC voltage is appropriately set so as to be a fog removal potential (difference between the surface potential of the photosensitive drum 1Y and the DC component of the developing voltage) suitable for the potential of the photosensitive drum 1Y in the developing region.

[Primary Transfer Roller]

The primary transfer roller 5Y is a primary transfer unit, which is brought into pressure contact with the photosensitive drum 1Y with a predetermined pressure force in a direction of sandwiching the intermediate transfer belt 7 with the photosensitive drum 1Y, and a pressure contact nip portion thereof corresponds to the primary transfer portion T1Y. The primary transfer roller 5Y is applied with a transfer voltage, which is +600 V in this embodiment, having a positive polarity opposite to a negative polarity being an original charging polarity of toner from a power supply (not shown). With this, the toner images on the photosensitive drums 1Y to 1K are sequentially transferred onto the surface of the intermediate transfer belt 7 electrostatically.

The intermediate transfer belt 7 having the toner images transferred thereto transfers the toner images onto the recording material S, which is fed from the cassette 11 at a predetermined timing, at the secondary transfer portion T2. In this embodiment, the secondary transfer outer roller 8*b* serving as a secondary transfer unit is arranged so as to be brought into contact with the intermediate transfer belt 7, to thereby form the secondary transfer portion T2. The secondary transfer outer roller 8*b* is applied with a transfer voltage of +800 V.

The recording material S having the toner images transferred thereto at the secondary transfer portion T2 is conveyed to the fixing device 10. In this embodiment, the fixing device 10 is a heat roller fixing device including a fixing roller and a pressure roller. The fixing roller includes a heat source therein. The pressure roller is brought into pressure contact with the fixing roller. When the recording material S is conveyed to the pressure contact nip portion between the fixing roller and the pressure roller, the recording material S is heated and pressurized, with the result that the toner images are fixed onto the recording material S.

[Intermediate Transfer Belt]

The intermediate transfer belt 7 serving as an intermediate transfer member is an endless belt. As a material for the intermediate transfer belt 7, a resin-based rubber belt or a rubber belt containing a metallic core, and a belt made of a resin and a rubber are desired. In order to suppress scattering of toner and a void in which a part of the toner image is not transferred, an intermediate transfer belt having an elastic layer may be used. As the intermediate transfer belt 7 in this embodiment, a resin belt containing carbon dispersed in polyimide (PI) and having a volume resistivity controlled to the order of 108 Ωcm is used. The intermediate transfer belt 7 has a thickness of 80 μm and an entire circumference of 900 mm.

[Photosensitive Drum]

Figure 2:
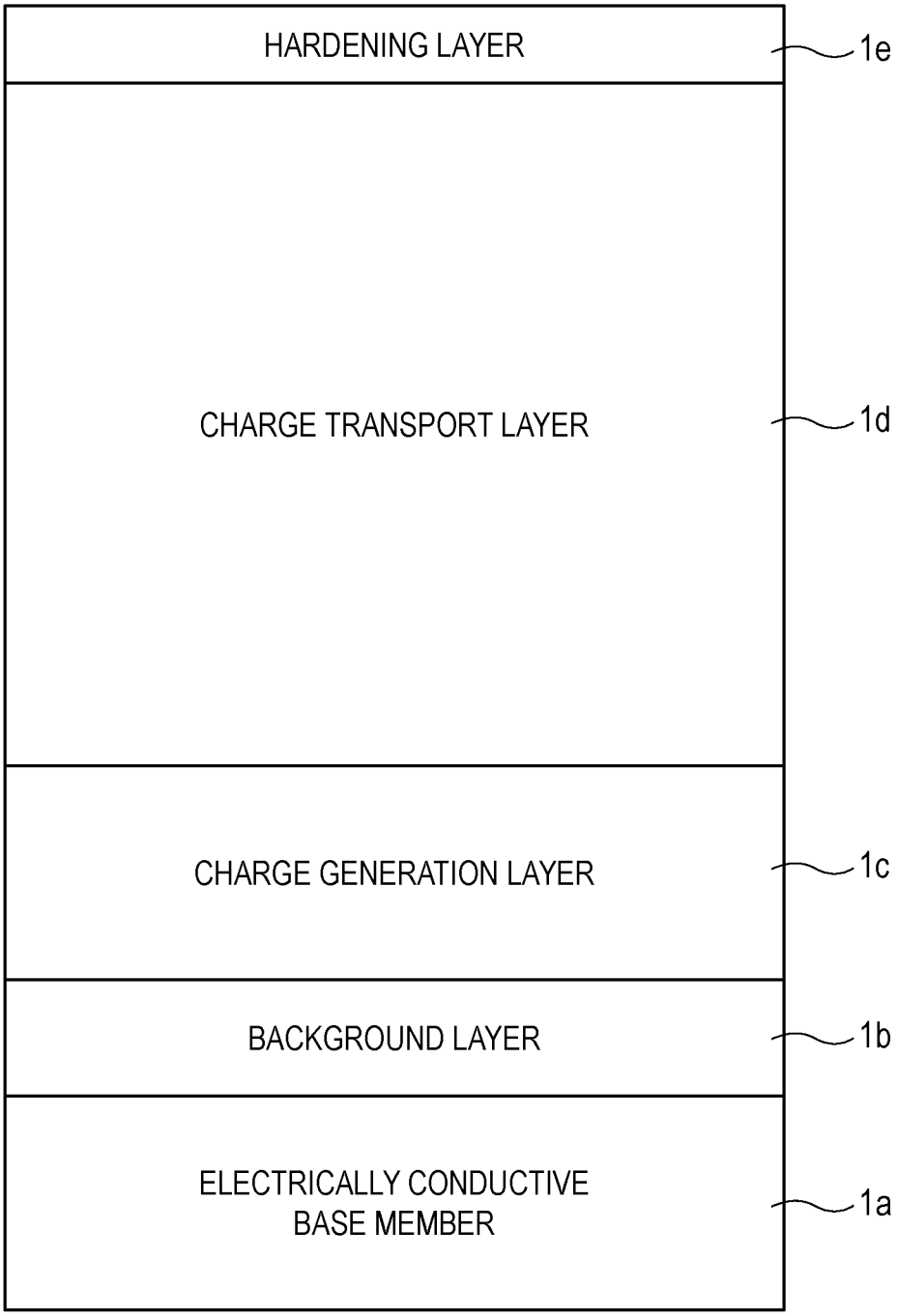
FIG. 2 is a schematic view for illustrating a layer configuration of a photosensitive drum in the embodiment.

The photosensitive drum 1Y serving as the photosensitive member is described with reference to FIG. 1 and FIG. 2.

The same description also applies to the other photosensitive drums 1M, 1C, and 1K. The photosensitive drum 1Y is a rotary drum-type organic electrophotographic photosensitive member having charging characteristics of negative chargeability. As illustrated in FIG. 2, the photosensitive drum 1Y has a layer configuration in which a charge generation layer 1*c* made of an organic material and a charge transport layer (thickness of about 20 μm) 1*d* are recoated successively from a lower portion on a surface of an electrically conductive base member (aluminum cylinder) 1*a* through intermediation of a background layer 1*b*.

In this case, a hardening layer 1*e* using a curable resin as a binder resin is used as a surface layer of the photosensitive drum 1Y. In this embodiment, the hardening layer 1*e* using a curable resin for surface hardening treatment of the photosensitive drum 1Y is used. However, the hardening layer is not limited thereto, and a charge-transporting hardening layer, which is formed by hardening and polymerizing a monomer having a carbon-carbon double bond and a charge-transporting monomer having a carbon-carbon double bond with heat energy or light energy, may be used as the hardening layer. Further, a charge-transporting hardening layer, which is formed by hardening and polymerizing a hole-transporting compound having a chain-polymerizable functional group in the same molecule with electron beam energy, may be used as the hardening layer.

As indicators of the hardening layer 1*e* of the photosensitive drum 1Y, a universal hardness HU and an elastic deformation rate We are measured under an environment having a temperature of 25° C. and a relative humidity of 50%. The universal hardness HU and the elastic deformation rate We are measured through use of a Fischerscope H100V (manufactured by Fischer Instruments K.K.) as a micro hardness measurement apparatus which is capable of determining a continuous hardness by continuously applying a load to an indenter and directly reading an indentation depth under the load. As the indenter, a Vickers quadrangular pyramid diamond indenter having a facing angle of 136° is used.

As the load condition, the load is increased to a final load (that is, a maximum load) of 6 mN in stages (273 points in a retention time of 0.1 s at each point). The universal hardness HU is defined by dividing a test load during indentation at the maximum load of 6 mN by the surface area of the Vickers quadrangular pyramid diamond indenter at the test load. The elastic deformation rate We is determined based on an amount (energy) of work which the indenter performs with respect to the hardening layer, that is, a change in energy of the indenter caused by increase and decrease in load with respect to the hardening layer. Thus, the elastic deformation rate We is a result which is obtained by dividing an amount of work Wo of an elastic deformation rate by a total amount of work Wt and presented in percentage.

As the performance required in the photosensitive drum 1Y, there is given improvement of durability against mechanical deterioration. That is, an electrical external force and a mechanical external force are directly applied to the surface of the photosensitive drum 1Y during charging, exposure, development, transfer, and cleaning, and hence the photosensitive drum 1Y is required to have durability against those external forces. Specifically, the photosensitive drum 1Y is required to have durability against the occurrence of scratches and wear on the surface caused by those external forces, that is, scratch resistance and wear resistance. In general, it is considered that the hardness of the hardening layer is higher as the deformation amount thereof against external stress is smaller, and that the durability of the photosensitive drum with respect to mechanical deterioration is improved as the pencil hardness and Vickers hardness thereof are higher.

However, it is not necessarily expected that the durability is improved as the above-mentioned hardness obtained by those measurements is higher. As a result of extensive investigations, the inventors of the present invention have found that, when the values of the universal hardness HU and the elastic deformation rate We fall within a certain range, the mechanical deterioration of the surface layer of the photosensitive drum is less liable to occur. First, a hardness test is performed through use of a Vickers quadrangular pyramid diamond indenter under an environment having a temperature of 25° C. and a relative humidity of 50%. In this case, the durability against the mechanical deterioration is significantly improved through use of the photosensitive drum 1Y in which the universal hardness HU during indentation at the maximum load of 6 mN is 150 N/mm2 or more and 220 N/mm2 or less, and the elastic deformation rate We is 40% or more and 65% or less.

Further, in order to further improve the durability of the photosensitive drum 1Y, it is more preferred that the universal hardness HU be 160 N/mm2 or more and 200 N/mm2 or less. The universal hardness HU and the elastic deformation rate We cannot be considered separately. For example, in a case in which the universal hardness HU is more than 220 N/mm2, the elastic force of the photosensitive drum 1Y becomes insufficient when the elastic deformation rate We is less than 40%. Meanwhile, in a case in which the elastic deformation rate We is more than 65%, the elastic deformation amount becomes small even when the elastic deformation rate We is high. In any case, a large pressure is locally applied consequently to cause a deep scratch in the photosensitive drum 1Y. Thus, it is considered that a photosensitive drum having a high universal hardness HU is not necessarily optimum as a photosensitive drum.

Further, in a case in which the universal hardness HU is less than 150 N/mm2, and the elastic deformation rate We is more than 65%, the plastic deformation amount becomes large even when the elastic deformation rate We is high. Thus, the surface of the photosensitive drum 1Y is rubbed by paper powder and toner sandwiched between the photosensitive drum 1Y and the drum cleaner 6Y and between the photosensitive drum 1Y and the charge roller 2Y. As a result, the surface of the photosensitive drum 1Y is worn, and fine scratches are formed on the surface of the photosensitive drum 1Y.

[Surface Shape of Photosensitive Drum]

Next, the surface shape of the photosensitive drum 1Y in this embodiment is described with reference to FIG. 3A to FIG. 3H and FIG. 4A to FIG. 4F. The photosensitive drum 1Y in this embodiment has a plurality of independent recesses 200 on the surface.

When the durability of the surface of the photosensitive drum 1Y against mechanical deterioration, such as wear resistance, is improved, a discharge product generated by discharge of the charging device and a wax component contained in toner, which adhere to the surface of the photosensitive drum 1Y, cannot be easily removed with the drum cleaner 6Y. When the discharge product and the wax component are accumulated on the surface of the photosensitive drum 1Y, the friction increases between the photosensitive drum 1Y and a cleaning blade 60 (described later, FIG. 5) of the drum cleaner 6Y, which is configured to remove residual toner on the photosensitive drum 1Y by being brought into contact with the surface of the photosensitive drum 1Y. Such increase in friction causes the behavior of the cleaning blade 60 to be unstable, which results in causing an image defect due to the unstable behavior of the cleaning blade 60 and wear of the cleaning blade 60.

In order to suppress the image defect due to the unstable behavior of the cleaning blade 60 and the wear of the cleaning blade 60, the surface layer of the photosensitive drum 1Y is roughened. In this embodiment, as a technology of roughening the surface layer, the plurality of independent recesses 200 are formed on the surface of the photosensitive drum 1Y. FIG. 3A to FIG. 3H are each a view for illustrating an example of a specific aperture shape of each of the recesses 200 formed on the surface of the photosensitive drum 1Y. FIG. 4A to FIG. 4F are each a view for illustrating an example of a sectional shape of each of the recesses 200.

In FIG. 3A to FIG. 3H and FIG. 4A to FIG. 4F, "a" represents an aperture width of the recess 200 in the rotational axis direction (width direction crossing the rotation direction) of the photosensitive drum 1Y, "b" represents an aperture width of the recess 200 in the rotation direction (circumferential direction), and "h" represents a depth of the recess 200. As the shape of the aperture of each of the recesses 200, it is possible to form, for example, a circle, a rectangle, a triangle, a rhombus, and an oval as illustrated in FIG. 3A to FIG. 3E, and shapes obtained by combining the shapes of FIG. 3A to FIG. 3E as illustrated in FIG. 3F to FIG. 3H. The shape of the aperture of the recess 200 may be asymmetric with respect to the rotational axis direction and the circumferential direction.

Further, as the shape of the cross section of each of the recesses 200, it is possible to form various shapes, for example, shapes having an edge such as a triangle and a rectangle, a wave shape formed of a continuous curve, and shapes of a triangle and a rectangle in which a part or an entirety of an edge is deformed into a curve as illustrated in FIG. 4A to FIG. 4F. The shape of the cross section may be asymmetric with respect to the rotational axis direction and the circumferential direction.

The plurality of recesses 200 formed on the surface of the photosensitive drum 1Y may have the same shape, size, and depth, or may have different shapes, sizes, and depths.

The aperture width "a" of each of the recesses 200 in the rotational axis direction is defined as an aperture width, which becomes maximum, among aperture widths measured along a straight line that crosses across each of the recesses 200 in the rotational axis direction as illustrated in FIG. 3A to FIG. 3H. Similarly, the aperture width "b" of each of the recesses 200 in the circumferential direction is defined as a length, which becomes maximum, among lengths measured along a straight line that crosses across each of the recesses 200 in the circumferential direction.

The plurality of recesses 200 may be formed in an entire region of the surface of the photosensitive drum 1Y or may be formed in a part of the surface. In order to exhibit satisfactory performance, it is desired that the plurality of recesses 200 be formed at least in a surface portion that is brought into contact with the cleaning blade 60.

In this embodiment, the aperture width "a" of each of the recesses 200 in the rotational axis direction and the aperture width "b" of each of the recesses 200 in the circumferential direction are preferably 5 μm or more and 100 μm or less, and more preferably 10 μm or more and 80 μm or less. When the aperture width "a" in the rotational axis direction and the aperture width "b" in the circumferential direction are less than 5 μm, the effects of this embodiment are less likely to be obtained, and the "toner fusion" is liable to occur. When the aperture width "a" in the rotational axis direction and the aperture width "b" in the circumferential direction are more than 100 μm, the effect of reducing a friction force by roughening the photosensitive drum 1Y is not likely to be obtained sufficiently.

Further, the depth "h" of each of the recesses 200 in this embodiment is preferably 0.1 μm or more and 3 μm or less. When the depth "h" is less than 0.1 μm, the effect of reducing a friction force by roughening the photosensitive drum 1Y is not likely to be obtained sufficiently. When the depth "h" is more than 3 μm, the effect of this embodiment is less likely to be obtained, and the "toner fusion" is liable to occur. In this embodiment, each of the recesses 200 is suitably arranged and can be optimized.

In this embodiment, it is further preferred that the area ratio of the apertures of the recesses 200 be 40% or more. When the area ratio of the recesses is less than 40%, the effect of reducing a friction force is less likely to be obtained sufficiently. In this case, the area ratio of the apertures is a ratio of the total area of the apertures of the recesses 200 in a square region measuring 500 μm on each side, which is determined by the following expression.

{Total area of apertures of recesses/(total area of apertures of recesses+total area of non-recess)×100}

Further, the plurality of recesses 200 of the photosensitive drum 1Y can be observed through use of a microscope, for example, a laser microscope, an optical microscope, an electron microscope, or an atomic force microscope. As the laser microscope, it is possible to use for example, the following devices: an ultra-depth shape measurement microscope VK-8550, an ultra-depth shape measurement microscope VK-9000, an ultra-depth shape measurement microscope VK-9500, VK-X200, and VK-X100 manufactured by Keyence Corporation; and a scanning confocal laser microscope OL S3000 manufactured by Olympus Corporation.

As the optical microscope, it is possible to use, for example, the following devices: a digital microscope VHX-500 and a digital microscope VHX-300 manufactured by Keyence Corporation.

As the electron microscope, it is possible to use, for example, the following devices: a 3D real surface view microscope VE-9800 and a 3D real surface view microscope VE-8800 manufactured by Keyence Corporation; and a scanning electron microscope Superscan SS-550 manufactured by Shimadzu Corporation.

As the atomic force microscope, it is possible to use, for example, the following devices: a nanoscale hybrid microscope VN-8000 manufactured by Keyence Corporation; and a scanning probe microscope SPM-9600 manufactured by Shimadzu Corporation.

A shape, an aperture width, a depth, and an area ratio of an aperture in a measurement field of view can be measured with a predetermined magnification through use of the above-mentioned microscopes, and further, an average aperture width, an average depth, and an area ratio of an aperture per unit area can be determined by calculation.

In this embodiment, the photosensitive drum 1Y has a length in an axial direction of 340 mm and an outer diameter of 30 mm and is driven to rotate in a direction indicated by the curved arrow at a process speed (circumferential speed) of 200 mm/sec about a center spindle.

[Drum Cleaner]

Next, the cleaning blade 60 of the drum cleaner 6Y is described with reference to FIG. 5. The same description also applies to the cleaning blades of other drum cleaners 6M, 6C, and 6K. As described above, the drum cleaner 6Y is configured to remove the untransferred residual toner that slightly remains on the photosensitive drum 1Y from the surface thereof after the toner image transfer to the intermediate transfer belt 7 at the primary transfer portion T1Y. Therefore, the drum cleaner 6Y includes the cleaning blade 60, which is brought into contact with the surface of the photosensitive drum 1Y, and a collection container (not shown) configured to collect toner collected by the cleaning blade 60.

The cleaning blade 60 includes a plate-like rubber member 61 and a sheet metal member 62. The plate-like rubber member 61 has a distal end portion that is brought into contact with the surface of the photosensitive drum 1Y. The sheet metal member 62 serves as a support member configured to support a base end side of the rubber member 61. In this embodiment, the cleaning blade 60 has a configuration in which the rubber member 61 made of a flat plate-shaped urethane rubber is bonded to the sheet metal member 62 with an adhesive. The rubber member 61 has a thickness of 2 mm and is bonded to the sheet metal member 62 with a free length of 8 mm from the position at which the rubber member 61 is supported by the sheet metal member 62 to the distal end.

Further, the cleaning blade 60 has a length of 330 mm in a longitudinal direction (direction parallel to the rotational axis direction of the photosensitive drum 1Y when the cleaning blade 60 is brought into contact with the photosensitive drum 1Y). The cleaning blade 60 is brought into contact with the surface of the photosensitive drum 1Y so that a contact force (linear pressure) per unit length in the longitudinal direction is 0.196 N/cm or more (20 gf/cm or more) and 0.490 N/cm or less (50 gf/cm or less). That is, the cleaning blade 60 is pressed against the photosensitive drum 1Y at a linear pressure within a range of from 20 gf/cm to 50 gf/cm.

When the linear pressure is less than 0.196 N/cm (20 gf/cm), the contact pressure between the cleaning blade 60 and the photosensitive drum 1Y becomes small, and the untransferred residual toner cannot be sufficiently blocked. As a result, a cleaning defect in which the untransferred residual toner passes by the cleaning blade 60 is liable to occur. Meanwhile, when the linear pressure is more than 0.490 N/cm (50 gf/cm), the friction force between the cleaning blade 60 and the photosensitive drum 1Y increases, and problems such as blade chattering, blade wear, and blade chipping occur, with the result that a satisfactory cleaning property is not obtained.

Further, in the cleaning blade 60, W/a obtained by dividing the linear pressure by an inroad amount with respect to the photosensitive drum 1Y is set as described below. Specifically, the cleaning blade 60 is formed so that W/a, which is given at a time when the cleaning blade 60 is brought into contact with the photosensitive drum 1Y so as to form a contact angle of 25° with respect to the photosensitive drum 1Y, satisfies the following condition. That is, W/a is 0.196 N/cm/mm or more (20 gf/cm/mm or more) and 0.441 N/cm/mm or less (45 gf/cm/mm or less). The contact angle and the inroad amount are described later. Further, in this embodiment, the inroad amount is set to, for example, 0.5 mm or more and 2 mm or less. Note that the inroad amount of the cleaning blade 60 with respect to the photosensitive drum 1Y means in this embodiment an imaginary inroad amount but the cleaning blade 60 does not make inroad into the photosensitive drum 1Y.

When W/a is less than 0.196 N/cm/mm (20 gf/cm/mm), the inroad amount for obtaining a required linear pressure increases, and the contact width between the cleaning blade 60 and the photosensitive drum 1Y is extended to decrease a peak pressure, with the result that the toner fusion is liable to occur. Meanwhile, when W/a is more than 0.441 N/cm/mm (45 gf/cm/mm), an abrading amount by which the surface layer of the photosensitive drum 1Y is abraded by the cleaning blade 60 increases, and the wear life of the photosensitive drum 1Y decreases.

[Mechanism of Toner Fusion]

Now, the mechanism of the toner fusion is described with reference to FIG. 6. Formation of an image having a high image ratio under a high-temperature and high-humidity environment causes occurrence of the toner fusion, in some cases, originating from the recesses 200 in the photosensitive drum 1Y having the recesses 200 formed on the surface. The following is considered as cause of such toner fusion. The peak pressure from the cleaning blade 60 cannot be sufficiently obtained in the recess 200, and the toner adhering to the recess 200 cannot be scraped off, causing growth of the toner fusion originating from the recesses 200.

Figure 6:
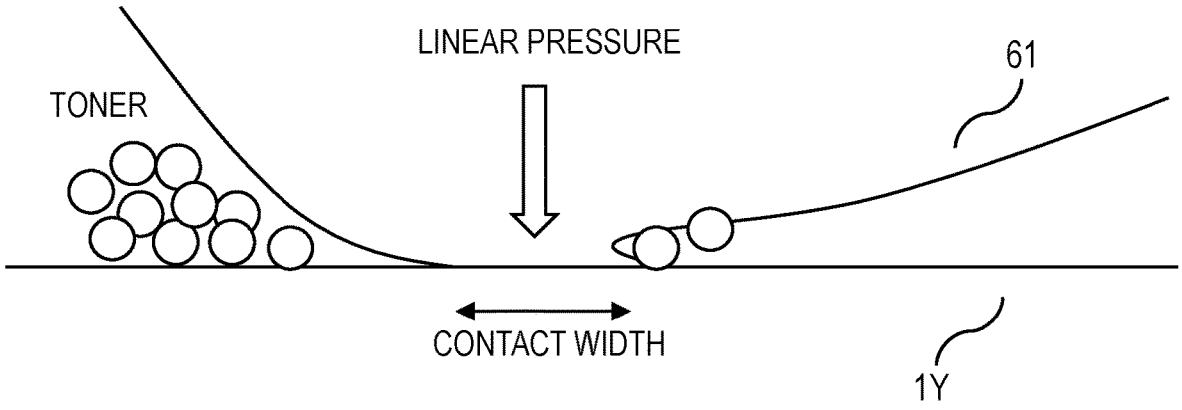
FIG. 6 is a schematic view for illustrating a mechanism of toner fusion.

FIG. 6 is a schematic view for illustrating a cross section of a contact portion between the rubber member 61 of the cleaning blade 60 and the photosensitive drum 1Y. In order to suppress the toner fusion, it is desired to improve elimination ability of the cleaning blade 60 in the recess 200 so as to scrape off the toner adhering to the recess 200. In order to improve the elimination ability of the cleaning blade 60 in the recess 200, it is required to reduce the width (contact width) of the contact surface between the rubber member 61 of the cleaning blade 60 and the photosensitive drum 1Y in the recess 200 to increase the peak pressure.

In order to reduce the contact width, it is preferred that curling of the rubber member 61, which occurs on the contact surface between the rubber member 61 and the photosensitive drum 1Y, be reduced. The curling of the rubber member 61 occurs through deformation of the rubber member 61 with respect to the friction force that is received from the photosensitive drum 1Y when the rubber member 61 is brought into contact with the photosensitive drum 1Y.

In view of the foregoing, in this embodiment, toner having a glass transition temperature Tg as low as 65° C. or less, more preferably 55° C. or less is used as the toner as described above from the viewpoint of low-temperature fixability. In general, the toner having a low glass transition temperature Tg is liable to adhere to the photosensitive drum 1Y at a time of increase in temperature, and the toner fusion is liable to occur. Toner that is generally used has a glass transition temperature of about 60° C.

[Rubber Member]

In this embodiment, in order to suppress the occurrence of the toner fusion even in the configuration in which the toner having a low glass transition temperature Tg is used, and in which the surface of the photosensitive drum 1Y having the plurality of recesses 200 formed thereon is cleaned, the rubber member 61 of the cleaning blade 60 is formed as described below.

Figure 5:
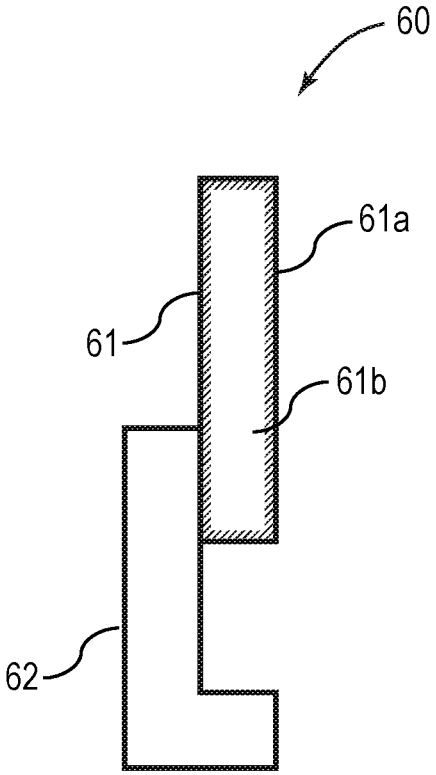
FIG. 5 is a side view for illustrating a schematic configuration of a cleaning blade in the embodiment.

As illustrated in FIG. 5, the rubber member 61 has a surface layer 61*a* having a high hardness on the surface of a base layer 61*b*. The surface layer 61*a* is formed at least on a contact surface between the rubber member 61 and the photosensitive drum 1Y and is present within a range of 1 mm from the surface of the rubber member 61 in a depth direction.

With the hardness of the surface layer 61*a* of the cleaning blade 6 being an indicator, the indentation elastic modulus is measured under an environment having a temperature of 25° C. and a relative humidity of 50% (hardness test). The indentation elastic modulus is measured through use of a micro hardness measurement apparatus Fischerscope HM2000LT (manufactured by Fischer Instruments K.K.) which is capable of determining a continuous hardness by continuously applying a load to an indenter and directly reading an indentation depth under the load. As the indenter, a Vickers quadrangular pyramid diamond indenter having a facing angle of 136° is used. The load condition is as follows. The load is increased to a final load (that is, a maximum load) of 0.98 mN at a load speed of 0.14 mN/s. After that, the final load of 0.98 mN is kept for 5 seconds, and the pressure is reduced (load is removed) at a load speed of 0.14 mN/s.

In the hardness test, the rubber member 61 is cut out from the cleaning blade 60 and fixed to a glass plate having a thickness of 2 mm. Then, the indentation elastic modulus given at a time of removal of a load is measured. In this case, a surface extending in the longitudinal direction (direction parallel to the rotational axis direction of the photosensitive drum 1Y when the rubber member 61 is brought into contact with the photosensitive drum 1Y) of the rubber member 61 and the free length direction (direction directed from the base end of the rubber member 61 to the distal end thereof) is defined as a free length surface (first surface). Further, a surface extending in the longitudinal direction of the rubber member 61 and the thickness direction thereof is defined as a thickness surface (second surface).

Measurement points on the free length surface are set to a point of 30 μm from a contact edge at which the cleaning blade 60 is brought into contact with the surface of the photosensitive drum 1Y and a free length center (4 mm from the contact edge in this embodiment). Meanwhile, measurement points on the thickness surface are set to a point of 30 μm from the contact edge and a thickness center (1 mm from the contact edge in this embodiment).

The rubber member 61 is formed so that a difference, which is larger, among a difference in indentation elastic modulus between the two measurement points on the free length surface and a difference in indentation elastic modulus between the two measurement points on the thickness surface is 0.5 MPa or more and 10.0 MPa or less. Specifically, the entire surface and a range of 100 μm in the depth direction of the rubber member 61 made of a urethane rubber are hardened by isocyanate treatment so as to satisfy the above-mentioned condition, to thereby form the rubber member 61 having the surface layer 61*a*. It is more preferred that the difference in indentation elastic modulus be set to 0.5 MPa or more and 3.0 MPa or less.

However, the rubber member 61 is not limited thereto. The rubber member 61 may have a configuration in which the surface is hardened by treatment through use of isocyanurate or may have a two-layer structure in which two different kinds of materials are laminated. When the difference in indentation elastic modulus is 0.5 MPa or less, the surface layer 61*a* is not sufficiently hardened, and the effect of reducing a contact width is low, with the result that the occurrence of the toner fusion cannot be suppressed sufficiently. Meanwhile, when the difference in indentation elastic modulus is 10.0 MPa or more, the wear resistance of the surface layer 61*a* is degraded, and image defects caused by blade wear and blade chipping occur.

As described above, in order to reduce the curling of the rubber member 61, which causes the toner fusion, there are given a method involving increasing the hardness of the rubber member 61 to reduce a deformation amount thereof and a method involving decreasing the friction coefficient of the rubber member 61 to reduce a friction force from the photosensitive drum 1Y. In this embodiment, in a contact width measurement method described later, the rubber member 61 having a contact width of 4 μm or more and 8 μm or less at a linear pressure of 0.196 N/cm (20 gf/cm) and having a contact width of 4 μm or more and 13.5 μm or less at a linear pressure of 0.490 N/cm (50 gf/m) is used.

When the contact width is less than 4 μm, the contact width becomes unstable, and the rubber member 61 is not brought into contact with the photosensitive drum 1Y in a deep portion of each of the recesses 200, with the result that the toner fusion is liable to occur. When the contact width is more than 13.5 μm, the peak pressure is decreased, with the result that the toner fusion originating from the recesses 200 is liable to occur.

[Contact Width Measurement Method]

Figure 7A:
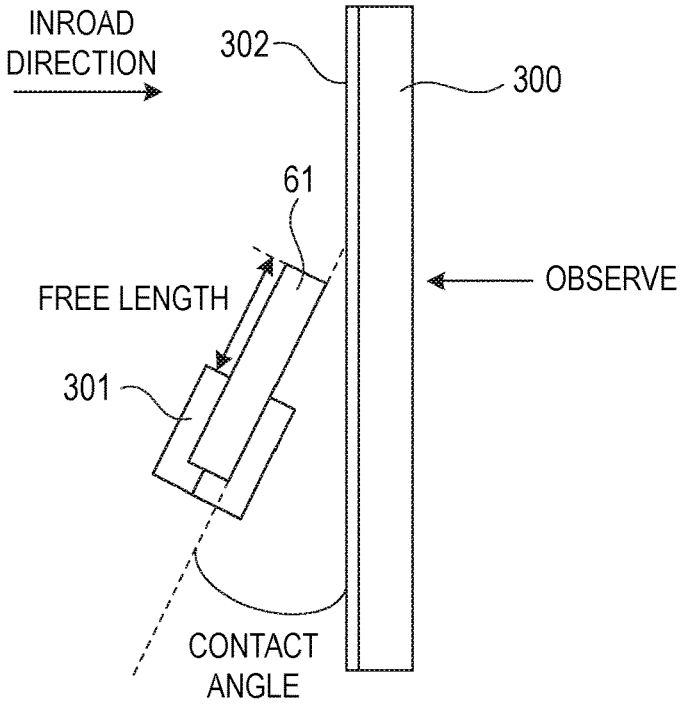
FIG. 7A is a schematic view of a contact width measurement apparatus in a state before a rubber member is brought into contact with a glass plate.
Figure 7B:
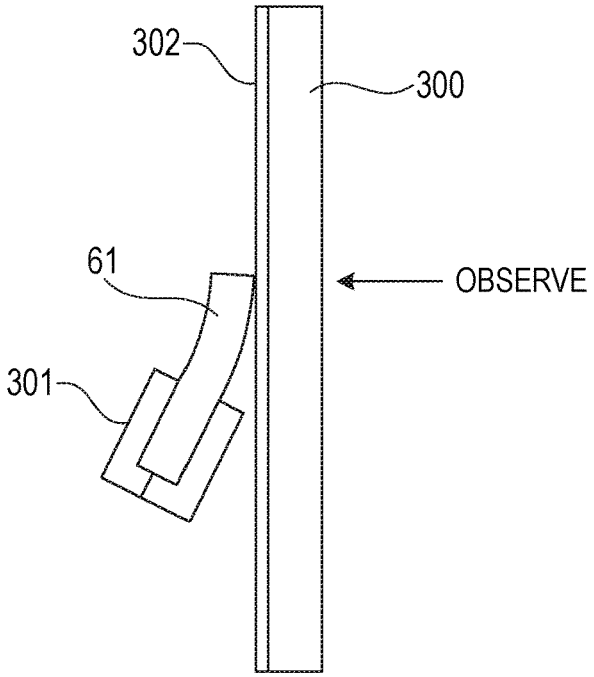
FIG. 7B is a schematic view of the contact width measurement apparatus in a state after the rubber member is brought into contact with the glass plate.
Figure 8:
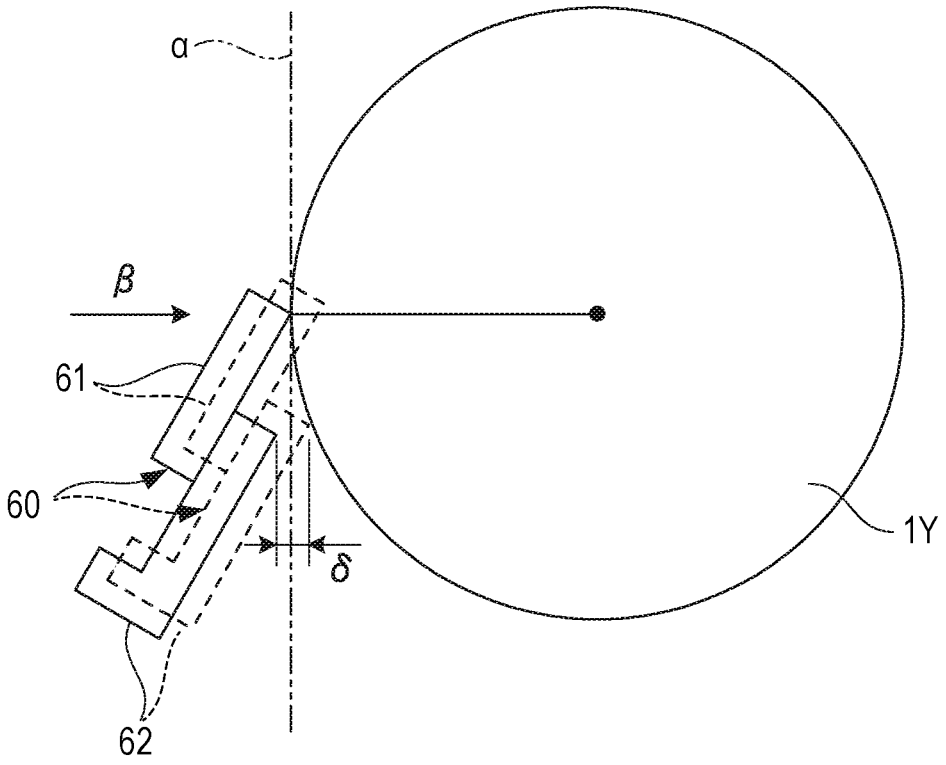
FIG. 8 is an explanatory schematic view for illustrating an inroad amount of the cleaning blade.

Next, a method of measuring a width of the contact surface (contact width) between the cleaning blade 60 and the photosensitive drum 1Y is described with reference to FIG. 7A, FIG. 7B, and FIG. 8. FIG. 7A and FIG. 7B are each a schematic view of a contact width measurement apparatus. The contact width measurement apparatus includes a glass plate 300, a holder 301, and a sheet 302. The glass plate 300 serves as an opposed object for measurement. The holder 301 is configured to hold the rubber member 61. The sheet 302 is bonded to the surface of the glass plate 300.

The contact width is measured by mounting the rubber member 61 of the cleaning blade 60 on the holder 301, bringing the rubber member 61 into contact with the surface of the glass plate 300 having the sheet 302 bonded thereto, and observing the resultant from a rear surface. FIG. 7A is a view for illustrating a state before the rubber member 61 is brought into contact with the glass plate 300, and FIG. 7B is a view for illustrating a state after the rubber member 61 is brought into contact with the glass plate 300.

The rubber member 61 is cut out from the cleaning blade 60 with a length (width) of 3 mm in the longitudinal direction and inserted into the holder 301 to be fixed thereto so as to have a free length of 8 mm. The holder 301 makes inroads with respect to the glass plate 300 at a contact angle of 25° in a direction perpendicular to the glass plate 300 (direction indicated by the arrow in FIG. 7A), and the inroad amount is adjusted so that a linear pressure reaches 20 gf/cm and 50 gf/cm.

Now, the inroad amount of the rubber member 61 is described with reference to FIG. 8. FIG. 8 is a view for illustrating a state in which the cleaning blade 60 is brought into contact with the surface of the photosensitive drum 1Y at a predetermined contact angle (angle formed by a tangent "a" described later and the free length surface of the rubber member 61). First, consideration is given to the state in which the cleaning blade 60 is brought into contact with the surface of the photosensitive drum 1Y as indicated by the solid line so that the cleaning blade 60 is not bent. In this case, as indicated by the broken line, the cleaning blade 60 is pressed against the photosensitive drum 1Y in a direction "β" orthogonal to the tangent "α" of the photosensitive drum 1Y passing through a contact point between the rubber member 61 and the surface of the photosensitive drum 1Y. Then, the rubber member 61 is bent, and the position of the sheet metal member 62 that holds the rubber member 61 moves in the direction "β". A movement amount "δ" of the sheet metal member 62 in the direction "β" is defined as the inroad amount of the rubber member 61.

Figure 9A:
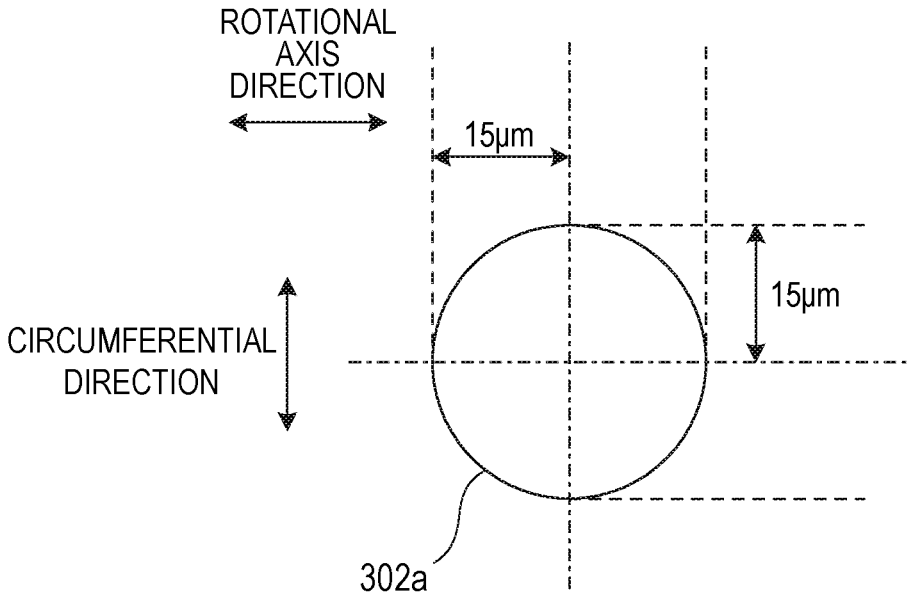
FIG. 9A is a view for illustrating an aperture shape of a measurement recess.
Figure 9B:
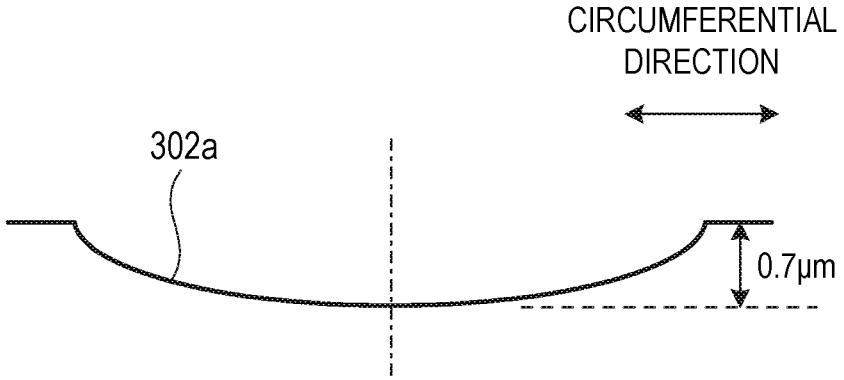
FIG. 9B is a view for illustrating a sectional shape of the measurement recess.

As illustrated in FIG. 9A and FIG. 9B, the sheet 302 on the surface of the glass plate 300, with which the rubber member 61 is brought into contact, has a plurality of recesses 302*a* serving as measurement recesses independently formed on the surface. The plurality of recesses 302*a* each have a partially spherical shape (dome-shape in this embodiment) with a depth of 0.7 μm and a radius of 15 That is, the glass plate 300 has the plurality of recesses 302*a*. FIG. 9A is a view for illustrating an aperture shape of the recess 302*a*, and FIG. 9B is a view for illustrating a sectional shape of the recess 302*a*.

In the contact width measurement method of this embodiment, the rubber member 61 is brought into contact with the surface of the glass plate 300 by the inroad amount described above, and the contact width of the rubber member 61 with respect to the recess 302*a* of the sheet 302 bonded to the surface of the glass plate 300 is measured. The contact portion becomes a shade against the rubber member 61, and hence the contact width can be measured by observing the glass plate 300 from a rear surface side. Note that the contact width in this embodiment means a length in a direction perpendicular to the longitudinal direction (width direction) of the blade, and is directed to a width in a vertical direction in FIG. 10.

Figure 10:
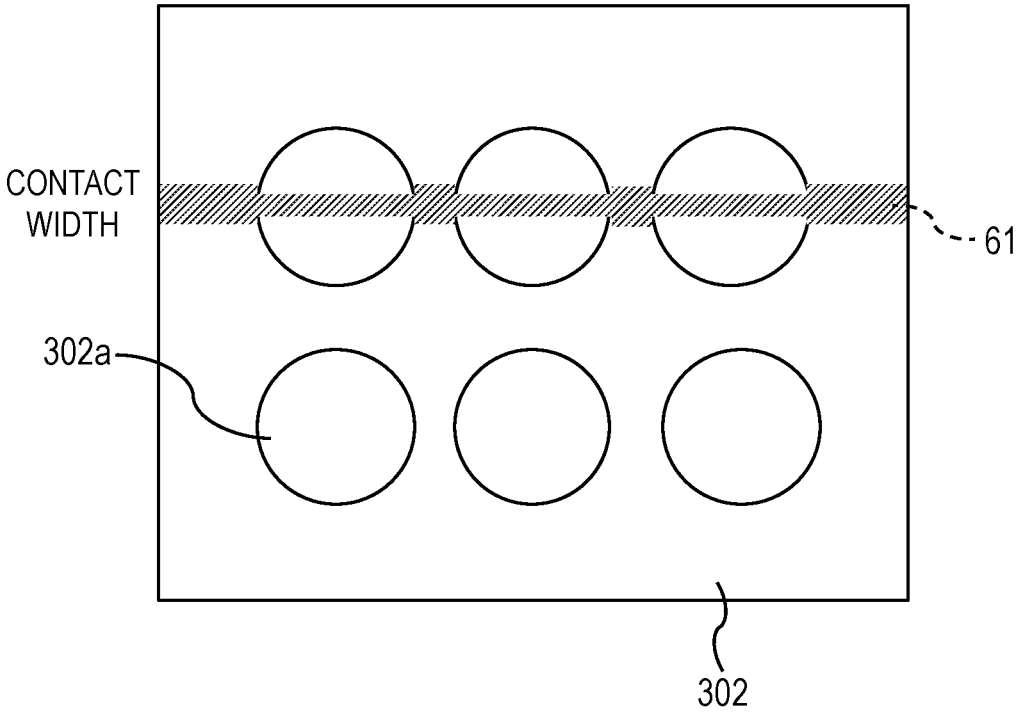
FIG. 10 is a schematic view for illustrating a contact width.

FIG. 10 is a schematic view for illustrating the contact width given at a time when the rubber member 61 is brought into contact with the sheet 302 of the glass plate 300. When the rubber member 61 makes inroads with respect to the glass plate 300, the contact width is formed. In each of the recesses 302*a*, the inroad amount is reduced by a recessed amount as compared to that in a flat portion in which the recesses 302*a* are not formed, and hence the contact width in each of the recesses 302*a* is smaller than that in the flat portion. The recesses 302*a* correspond to the recesses 200 formed on the surface of the photosensitive drum 1Y and represent a change in surface of the photosensitive drum 1Y caused by image formation. Thus, when the contact width is measured in the recess 302*a*, the contact width through a change in surface of the photosensitive drum 1Y caused by image formation can be checked. The sheet 302 is made of a material having hardness to some degree so as not to be substantially deformed with respect to the contact with the rubber member 61. Through such measurement, it can be measured whether or not the followability to the recess of the rubber member 61 and the peak pressure required for cleaning the recess are obtained.

[Toner Fusion Verification Experiment]

Next, a verification experiment for verifying a relationship between the contact width and the toner fusion is described. In Table 1, there is shown a relationship between the physical properties of rubber members used in the toner fusion verification experiment and the contact width. The toner fusion verification experiment was performed through use of six kinds of rubber members of rubbers A-1 to D-2 shown in Table 1. Further, the contact width was measured by the above-mentioned method.

TABLE 1

| | Physical properties of rubber | | | |
|---|---|---|---|---|
| | | Difference | Contact width (μm) | |
| Sample | Hardness of base layer (JIS-A) | in indentation hardness (MPa) | In the case of 20 gf/cm | In the case of 50 gf/cm |
| Rubber A-1 | 71 | 1.5 | 5.9 | 11.9 |
| Rubber A-2 | 79 | 1.1 | 5.6 | 12.5 |
| Rubber B-1 | 75 | 12.1 | 2.3 | 2.3 |
| Rubber C-1 | 71 | 5.1 | 6.3 | 14.2 |
| Rubber D-1 | 71 | 0 | 10.2 | 15.8 |
| Rubber D-2 | 79 | 0 | 6.3 | 14.2 |

In this case, the rubbers A-1 and A-2 are obtained by hardening the surface layer 61*a* by isocyanate treatment as described with reference to FIG. 5, and the hardness of the base layer 61*b* is given within the above-mentioned treatment range. The rubber B-1 is obtained by hardening the surface layer 61*a* by isocyanate treatment as described with reference to FIG. 5, in which the isocyanate treatment time is extended so that the difference in indentation elastic modulus reaches 10 MPa or more.

Figure 11:
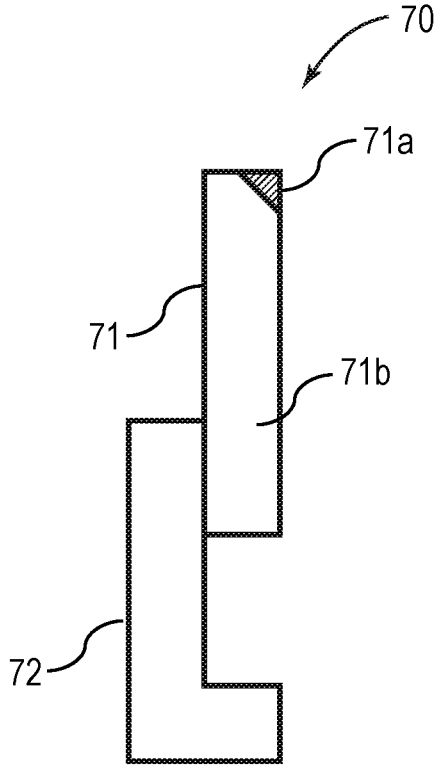
FIG. 11 is a side view for illustrating a schematic configuration of a cleaning blade in a Comparative Example.

The rubber C-1 is a rubber member 71 having a two-layer structure in which two different kinds of materials are laminated as illustrated in FIG. 11. FIG. 11 is a view for illustrating a cleaning blade 70 having the rubber member 71 formed on a sheet metal member 72 as a Comparative Example. The rubber member 71 includes a surface layer 71*a* laminated on a base layer 71*b*, and the surface layer 71*a* is present at a position of 1 mm in a free length direction and 0.5 mm in a thickness direction from the contact edge between the rubber member 71 and the photosensitive drum 1Y. The rubbers D-1 and D-2 are each a single-layer rubber member in which the hardness of the single layer is given.

Further, in Table 2, there are shown results obtained by investigating the toner fusion and the wear life of a photosensitive drum in a case in which the surface of the photosensitive drum is cleaned with each of the cleaning blades using the six kinds of rubber members of the rubbers A-1 to D-2. When the surface of the photosensitive drum is worn by rubbing with the cleaning blade, the chargeability of the photosensitive drum is decreased, and for example, image defects such as a vertical streak and a horizontal streak occur on an output image. Therefore, in the verification experiment, the wear life of the photosensitive drum was investigated as described below. Specifically, in a low-humidity environment (temperature of 22° C. and relative humidity of 5%), the cleaning blade using the rubber member of each sample was incorporated into an image forming apparatus, and an image was continuously formed on 200,000 sheets at an image ratio of 5%. Then, the presence or absence of image defects was visually checked. For example, when image defects such as a vertical streak and a horizontal streak occurred after the image was formed on less than 200,000 sheets, the result was defined as "×". When the image defects did not occur after the image was formed on 200,000 sheets, the result was defined as "○". The contact width of Table 2 is a value given at a time when the linear pressure is 0.490 N/cm (50 gf/cm).

TABLE 2

| Sample | Physical properties of blade: Hardness of base layer (JIS-A) | Physical properties of blade: Difference in indentation hardness (MPa) | Evaluation of physical properties: W/a (gf/cm/mm) | Evaluation of physical properties: Contact width (μm) | Evaluation of characteristics: Toner fusion | Evaluation of characteristics: Wear life of photosensitive drum |
|---|---|---|---|---|---|---|
| A-1 | 71 | 1.5 | 32 | 11.9 | ○ | ○ |
| A-2 | 79 | 1.1 | 41 | 12.5 | ○ | ○ |
| B-1 | 75 | 12.1 | 50 | 2.3 | x | x |
| C-1 | 71 | 5.1 | 32 | 14.2 | x | ○ |
| D-1 | 71 | 0 | 32 | 15.8 | x | ○ |
| D-2 | 79 | 0 | 41 | 14.2 | x | ○ |

It is understood from Table 2 that, when W/a was 0.441 N/cm/mm or less (45 gf/cm/mm or less), the wear life of the photosensitive drum was satisfactory. The toner fusion is described below.

In Table 3, there are shown an aperture shape, a sectional shape, an aperture width, a depth, and an aperture area ratio of the recess 200 of the photosensitive drum 1Y used in the toner fusion verification experiment. The toner fusion verification experiment was performed through use of nine kinds of photosensitive drums of photosensitive drums A-1 to F-1 shown in Table 3. Further, in order to perform an accelerative verification experiment, in the photosensitive drum used in the verification experiment, the depth of each of the recesses was set to 2 μm, and an aperture area ratio thereof was set to 40%.

The verification experiment was performed by bringing the rubbers A-1 and A-2 shown in Table 1 into contact with the photosensitive drums A-1 to F-1 shown in Table 3 so as to have a contact angle of 25°, a free length of 8 mm, and a linear pressure of 20 gf/cm. As the condition, an evaluation chart of an image having an image ratio of 20% of an A4-size in landscape orientation was continuously output on 5,000 sheets under a high-temperature and high-humidity environment (35° C., 70% RH). After that, the surface of each of the photosensitive drums was observed with a digital microscope VHX-300 manufactured by Keyence Corporation, and the toner fusion on the surface of the photosensitive drum was evaluated as described below. The results are shown in Table 4.

TABLE 3

Figure 3A:
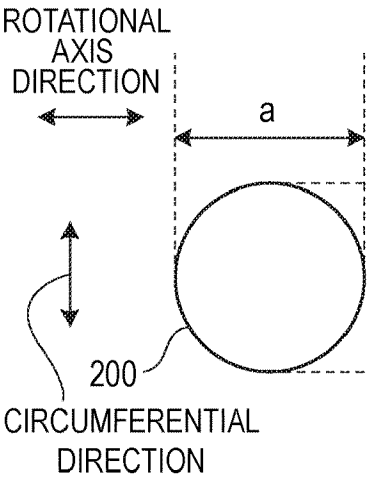
FIG. 3A, FIG. 3B, FIG. 3C, FIG. 3D, FIG. 3E, FIG. 3F, FIG. 3G, and FIG. 3H are each a view for illustrating an example of an aperture shape of a recess on a surface of the photosensitive drum in the embodiment.
Figure 3B:
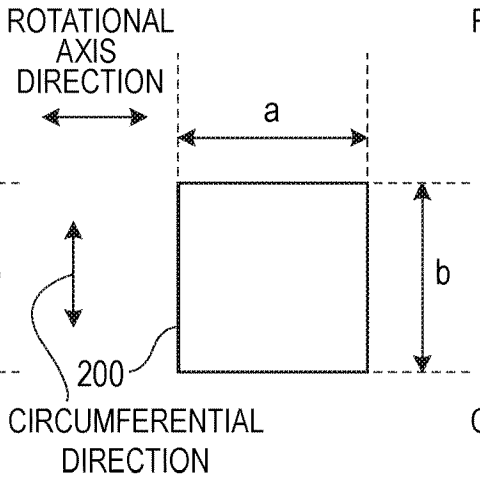
Figure 3C:
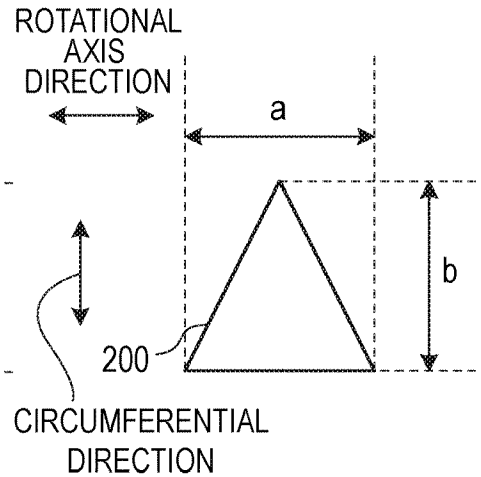
Figure 3D:
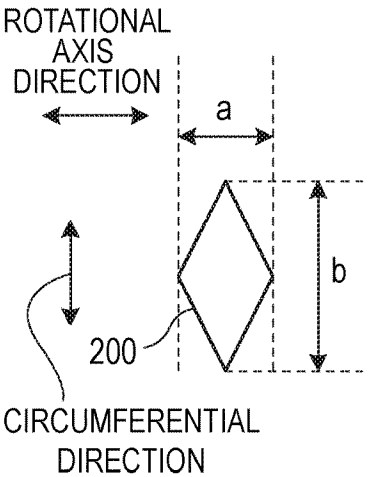
Figure 3E:
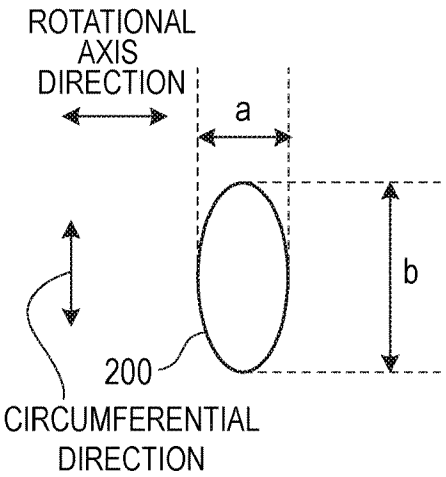
Figure 3F:
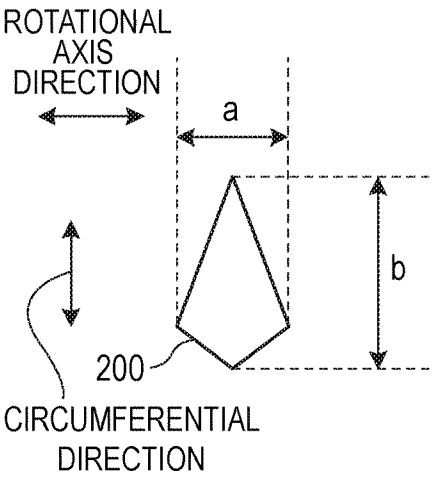
Figure 3G:
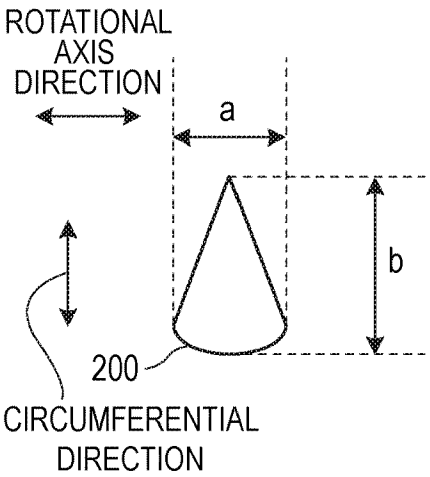
Figure 3H:
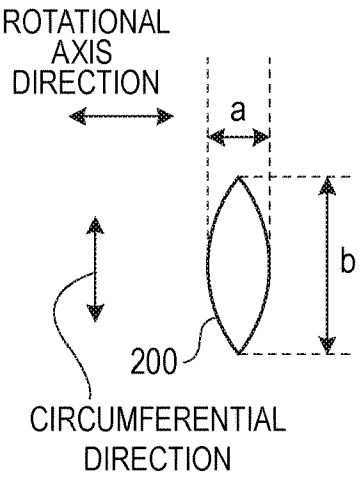
Figure 4A:
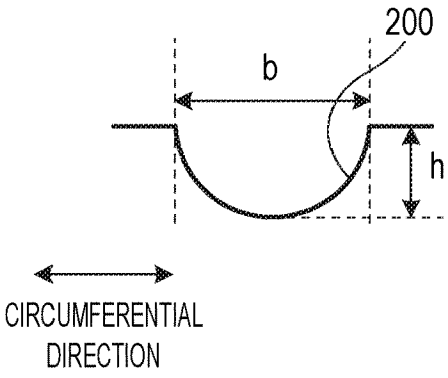
FIG. 4A, FIG. 4B, FIG. 4C, FIG. 4D, FIG. 4E, and FIG. 4F are each a view for illustrating an example of a sectional shape of the recess on the surface of the photosensitive drum in the embodiment.
Figure 4B:
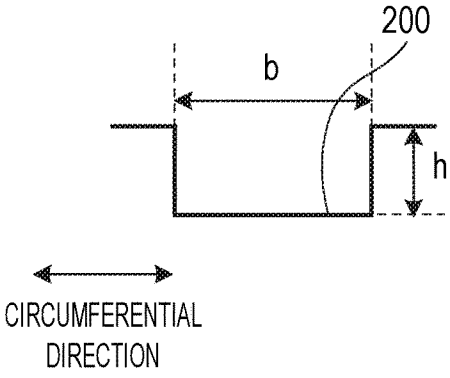
Figure 4C:
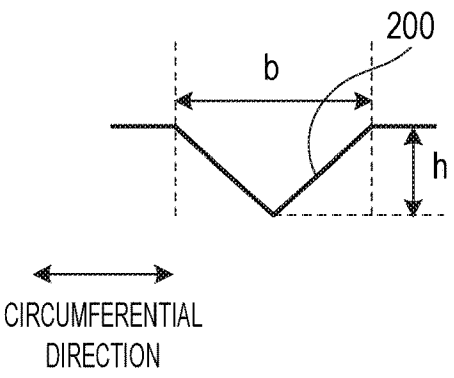
Figure 4D:
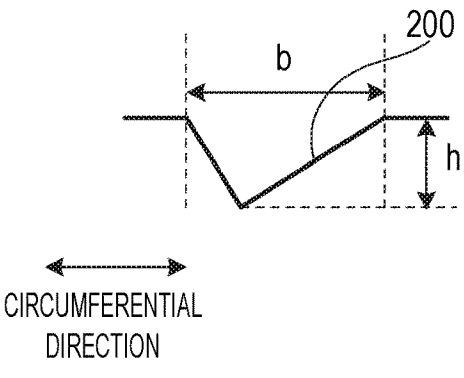
Figure 4E:
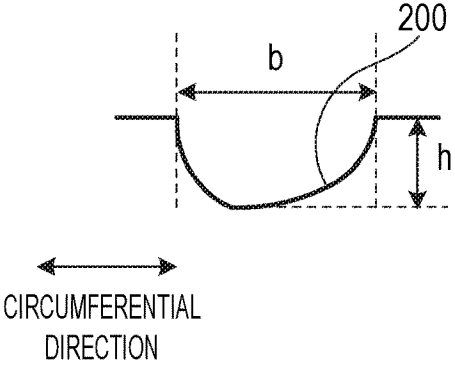
Figure 4F:
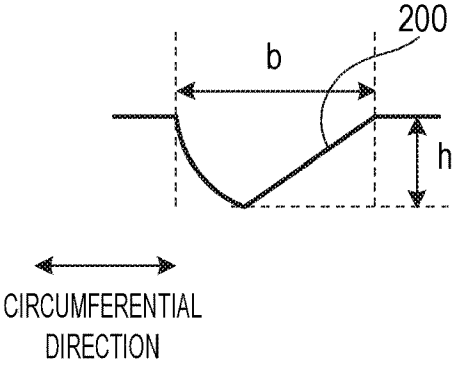

| Sample | Aperture shape | Sectional shape | Aperture width in rotational axis direction (μm) | Aperture width in circumferential direction (μm) | Depth (μm) | Aperture area ratio (%) |
|---|---|---|---|---|---|---|
| Photosensitive drum A-1 | FIG. 3A | FIG. 4A | 10 | 10 | 2 | 40 |
| Photosensitive drum A-2 | FIG. 3A | FIG. 4A | 50 | 50 | 2 | 40 |
| Photosensitive drum B-1 | FIG. 3E | FIG. 4A | 10 | 80 | 2 | 40 |
| Photosensitive drum B-2 | FIG. 3E | FIG. 4A | 5 | 100 | 2 | 40 |
| Photosensitive drum B-3 | FIG. 3E | FIG. 4A | 100 | 5 | 2 | 40 |
| Photosensitive drum C-1 | FIG. 3D | FIG. 4C | 10 | 80 | 2 | 40 |
| Photosensitive drum D-1 | FIG. 3F | FIG. 4D | 10 | 80 | 2 | 40 |
| Photosensitive drum E-1 | FIG. 3G | FIG. 4F | 10 | 80 | 2 | 40 |
| Photosensitive drum F-1 | FIG. 3H | FIG. 4A | 10 | 80 | 2 | 40 |

TABLE 4

| | Rubber member | Photosensitive drum | Evaluation results of toner fusion | Wear life of photosensitive drum |
|---|---|---|---|---|
| Example 1 | Rubber A-1 | Photosensitive drum A-1 | A | ○ |
| Example 2 | Rubber A-1 | Photosensitive drum A-2 | A | ○ |
| Example 3 | Rubber A-1 | Photosensitive drum B-1 | A | ○ |
| Example 4 | Rubber A-1 | Photosensitive drum B-2 | B | ○ |
| Example 5 | Rubber A-1 | Photosensitive drum B-3 | B | ○ |
| Example 6 | Rubber A-1 | Photosensitive drum C-1 | A | ○ |
| Example 7 | Rubber A-1 | Photosensitive drum D-1 | A | ○ |
| Example 8 | Rubber A-1 | Photosensitive drum E-1 | A | ○ |
| Example 9 | Rubber A-1 | Photosensitive drum F-1 | A | ○ |
| Example 10 | Rubber A-2 | Photosensitive drum A-1 | A | ○ |
| Example 11 | Rubber A-2 | Photosensitive drum A-2 | A | ○ |
| Example 12 | Rubber A-2 | Photosensitive drum B-1 | A | ○ |
| Example 13 | Rubber A-2 | Photosensitive drum B-2 | A | ○ |
| Example 14 | Rubber A-2 | Photosensitive drum B-3 | A | ○ |
| Example 15 | Rubber A-2 | Photosensitive drum C-1 | A | ○ |

TABLE 4-continued

| | Rubber member | Photosensitive drum | Evaluation results of toner fusion | Wear life of photosensitive drum |
|---|---|---|---|---|
| Example 16 | Rubber A-2 | Photosensitive drum D-1 | A | ○ |
| Example 17 | Rubber A-2 | Photosensitive drum E-1 | A | ○ |
| Example 18 | Rubber A-2 | Photosensitive drum F-1 | A | ○ |

A: Toner fusion does not occur on the surface of the photosensitive drum.
B: Extremely minor toner fusion can be slightly confirmed on the surface of the photosensitive drum.
C: Minor toner fusion occurs on the surface of the photosensitive drum.
D: Obvious toner fusion occurs on the surface of the photosensitive drum.

It is understood from Table 4 that, in all Examples 1 to 18, a cleaning blade satisfactory to the toner fusion was able to be provided. In particular, in the verification experiment, the photosensitive drums 1Y having the recesses 200 with the shapes shown in Table 3 were used. However, irrespective of the shape, the aperture width, the depth, and the aperture area ratio of the recess 200, results satisfactory to the toner fusion were obtained. Further, it was found that, in all Examples 1 to 18, the wear life of the photosensitive drum was satisfactory.

Meanwhile, results obtained by performing the verification experiment of the rubbers B-1 to D-2 shown in Table 1 with respect to the photosensitive drums A-1 to B-3 shown in Table 3 in the same manner as in Table 4 are shown in Table 5.

TABLE 5

| | Rubber member | Photosensitive drum | Evaluation results of toner fusion |
|---|---|---|---|
| Comparative Example 1 | Rubber B-1 | Photosensitive drum A-1 | D |
| Comparative Example 2 | Rubber B-1 | Photosensitive drum A-2 | C |
| Comparative Example 3 | Rubber B-1 | Photosensitive drum B-1 | C |
| Comparative Example 4 | Rubber B-1 | Photosensitive drum B-2 | D |
| Comparative Example 5 | Rubber B-1 | Photosensitive drum B-3 | D |
| Comparative Example 6 | Rubber C-1 | Photosensitive drum A-1 | D |
| Comparative Example 7 | Rubber C-1 | Photosensitive drum A-2 | C |
| Comparative Example 8 | Rubber C-1 | Photosensitive drum B-1 | C |
| Comparative Example 9 | Rubber C-1 | Photosensitive drum B-2 | D |
| Comparative Example 10 | Rubber C-1 | Photosensitive drum B-3 | D |
| Comparative Example 11 | Rubber D-1 | Photosensitive drum A-1 | D |
| Comparative Example 12 | Rubber D-1 | Photosensitive drum A-2 | D |
| Comparative Example 13 | Rubber D-1 | Photosensitive drum B-1 | D |
| Comparative Example 14 | Rubber D-1 | Photosensitive drum B-2 | D |
| Comparative Example 15 | Rubber D-1 | Photosensitive drum B-3 | D |
| Comparative Example 16 | Rubber D-2 | Photosensitive drum A-1 | D |
| Comparative Example 17 | Rubber D-2 | Photosensitive drum A-2 | C |
| Comparative Example 18 | Rubber D-2 | Photosensitive drum B-1 | C |
| Comparative Example 19 | Rubber D-2 | Photosensitive drum B-2 | D |
| Comparative Example 20 | Rubber D-2 | Photosensitive drum B-3 | D |

As is apparent from Table 5, in the case of Comparative Examples 1 to 20, results satisfactory to the toner fusion were not obtained. As described above, it was found that, in Examples 1 to 18 satisfying the configuration of this embodiment, results satisfactory to the toner fusion were obtained as compared to Comparative Examples 1 to 20.

As described above, in the cleaning blade 60 in this embodiment, the occurrence of the toner fusion can be suppressed with the configuration having the plurality of recesses 200 on the surface of the photosensitive drum 1Y.

OTHER EMBODIMENTS

In the above-mentioned embodiment, description is given of the case in which the present invention is applied to the cleaning blade 60 of the drum cleaner 6Y configured to clean the surface of the photosensitive drum 1Y serving as the image bearing member. However, the present invention may be applied to the belt cleaner 9 configured to clean the surface of the intermediate transfer belt 7 (intermediate transfer member) serving as the image bearing member. For example, when a resin belt is used as the intermediate transfer belt 7, the recesses 200 may be formed in the same manner as in the photosensitive drum 1Y. In this case, the occurrence of the toner fusion on the intermediate transfer belt 7 can be suppressed by forming a cleaning blade of the belt cleaner 9 in the same manner as the cleaning blade 60.

Further, the present invention can also be applied to a direct transfer type image forming apparatus configured to directly transfer an image from a photosensitive drum onto a recording material, in addition to the intermediate transfer type image forming apparatus having the intermediate transfer member as described above. Further, the photosensitive member may be a photosensitive belt instead of a photosensitive drum.

Further, the present invention can also be applied to image forming apparatus such as a copying machine, a facsimile machine, and a multifunctional peripheral, in addition to a printer.

According to the present invention, the occurrence of toner fusion can be suppressed with the configuration of an image bearing member having a plurality of recesses on a surface thereof.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-252606, filed Dec. 27, 2017, which is hereby incorporated by reference herein in its entirety.

What is claimed is:

1. An image forming apparatus comprising:

an image bearing member, which is configured to rotate while bearing a toner image; and a cleaning blade, which is to be brought into contact with a surface of the image bearing member, and is configured to clean the image bearing member, wherein the image bearing member has a plurality of recesses on a surface thereof, the plurality of recesses each having an aperture width of 5 μm or more and 100 μm or less in a rotational direction of the image bearing member, an aperture width of 5 μm or more and 100 μm or less in a width direction crossing the rotational direction of the image bearing member, and a depth of 0.1 μm or more and 3 μm or less, wherein the cleaning blade comprises a rubber member, a distal end portion of the cleaning blade, which is to be brought into contact with the image bearing member, having a hardness higher than a hardness of a base portion, a contact force per unit length in a longitudinal direction of the cleaning blade with respect to the surface of the image bearing member being 0.196 N/cm or more and 0.490 N/cm or less, and wherein, when the cleaning blade is supported so that a free length from a position at which the cleaning blade is supported to a distal end of the cleaning blade is 8 mm, and when the cleaning blade is brought into contact with an opposed object for measurement having a plurality of measurement recesses each having a partially spherical shape with a depth of 0.7 μm and a radius of 15 μm on a surface so that a contact angle with respect to the opposed object for measurement is 25°, a contact width in a direction perpendicular to the longitudinal direction of the cleaning blade between the cleaning blade and the opposed object for measurement in each of the measurement recesses is 4 μm or more and 8 μm or less when the contact force per unit length in the longitudinal direction of the cleaning blade is 0.196 N/cm, and is 4 μm or more and 13.5 μm or less when the contact force per unit length in the longitudinal direction of the cleaning blade is 0.490 N/cm.

2. An image forming apparatus according to claim 1, wherein, when the cleaning blade is brought into contact with the image bearing member so that the contact angle with respect to the image bearing member is 25°, W/a obtained by dividing the contact force per unit length in the longitudinal direction of the cleaning blade by an imaginary inroad amount of the cleaning blade with respect to the image bearing member is 0.196 N/cm/mm or more and 0.441 N/cm/mm or less.

3. An image forming apparatus according to claim 1, wherein, when a surface of the cleaning blade extending in the longitudinal direction and a free length direction is defined as a first surface, and a surface of the cleaning blade extending in the longitudinal direction and a thickness direction is defined as a second surface, a position of 30 μm from a contact edge at which the cleaning blade is brought into contact with the surface of the image bearing member and a center of the free length are set to measurement points on the first surface, and a position of 30 μm from the contact edge and a center of a thickness are set to measurement points on the second surface, wherein a difference in indentation elastic modulus at the two measurement points on the first surface is 0.5 MPa or more and 10.0 MPa or less, or wherein a difference in indentation elastic modulus at the two measurement points on the second surface is 0.5 MPa or more and 10.0 MPa or less.

4. An image forming apparatus according to claim 1, wherein, when the image bearing member is subjected to a hardness test through use of a Vickers quadrangular pyramid diamond indenter under an environment having a temperature of 25° C. and a relative humidity of 50%, and the Vickers quadrangular pyramid diamond indenter is pressed into the image bearing member at a maximum load of 6 mN, a universal hardness is 150 $N/mm^2$ or more and 220 $N/mm^2$ or less, and an elastic deformation rate We is 40% or more and 65% or less.

5. An image forming apparatus according to claim 1, wherein the cleaning blade is made of a urethane rubber.

6. An image forming apparatus according to claim 1, wherein the image bearing member comprises a photosensitive member.

7. An image forming apparatus according to claim 1, wherein the image bearing member comprises an intermediate transfer member to which the toner image formed on a photosensitive member is transferred.

* * * * *